US008333158B2

(12) United States Patent
Wise

(10) Patent No.: US 8,333,158 B2
(45) Date of Patent: Dec. 18, 2012

(54) PIVOTABLE SHELVING SYSTEM

(76) Inventor: Robert W. Wise, Petaluma, CA (US)

( * ) Notice: Subject to any disclaimer, the term of this patent is extended or adjusted under 35 U.S.C. 154(b) by 325 days.

(21) Appl. No.: 12/800,788

(22) Filed: May 21, 2010

(65) Prior Publication Data

US 2012/0037583 A1 Feb. 16, 2012

(51) Int. Cl.
*A47B 3/00* (2006.01)

(52) U.S. Cl. ..... 108/134; 108/108; 108/179; 211/90.02; 211/150; 211/193

(58) Field of Classification Search ..... 108/42, 108/134, 136, 2, 6, 9, 108, 110, 179, 147.11, 108/147.16–147.17, 152; 211/150, 103, 211/187, 190, 90.02, 90.01, 104, 193
See application file for complete search history.

(56) References Cited

U.S. PATENT DOCUMENTS 1,554,137 A * 9/1925 Slifkin ..... 108/6
2,906,486 A * 9/1959 Bellon et al. ..... 248/242
3,209,709 A * 10/1965 Shoffner ..... 108/27
3,570,679 A * 3/1971 Edson ..... 211/47
4,492,169 A * 1/1985 Ware et al. ..... 108/6
4,919,282 A * 4/1990 Duff et al. ..... 211/134
4,971,234 A * 11/1990 Hay ..... 224/42.32
4,976,205 A * 12/1990 Miller et al. ..... 108/47
5,090,579 A * 2/1992 Major ..... 211/126.1
5,408,936 A * 4/1995 Tseng ..... 108/42
6,196,141 B1 * 3/2001 Herron et al. ..... 108/108
6,205,934 B1 * 3/2001 Felton et al. ..... 108/107
7,337,730 B2 * 3/2008 Bienick et al. ..... 108/108

* cited by examiner

*Primary Examiner* — Hanh V Tran
(74) *Attorney, Agent, or Firm* — Lowe Graham Jones PLLC

(57) ABSTRACT

A shelving system includes shelves pivotally coupled to stanchions. The shelves are coupled to braces used to support the shelves in a working position. Further, the shelves include recesses for receiving the braces when the shelves are in a stored position. The shelves of the shelving system may be arranged such that all shelves may be moved from the working to stored position without interfering with an adjacent shelf. In one example, the shelves couple to the stanchions with spring loaded barrel bolts and rotate along a common bolt axis.

13 Claims, 5 Drawing Sheets

PIVOTABLE SHELVING SYSTEM

TECHNICAL FIELD

The invention relates to storage systems, and more specifically to shelving-type storage systems having pivotable shelves.

BACKGROUND OF THE INVENTION

Conventional shelving systems are generally well known and in contrast to free standing shelves or bookcases typically include a continuous shelf supported on at least two wall-mounted braces. In prior art systems of this type, the shelf is typically supported by the braces in a horizontal orientation after installation. Shelving systems of this type are popular with consumers for use in areas where aesthetic considerations are not paramount, such as in closets, garages, or the like; or where it may be beneficial to keep the floor area beneath the shelving clear of obstructions.

Some prior art shelving systems include a brace/shelf interface that permits the shelf to be vertically adjusted in a variety of ways, such as the shelving systems described in U.S. Pat. Nos. 6,065,821; 5,779,070; 5,152,595; and 4,750,623, and U.S. Patent Publication No. 2007/0176065. My own shelving system described in U.S. patent application Ser. No. 12/002,913, entitled Closet Shelving System, discloses a modular, continuous wall mounted shelving system. Nevertheless, all of these systems substantially maintain their deployed configuration once set up. Thus, space occupied by such continuous shelving systems is permanently dedicated to a single purpose.

SUMMARY OF THE INVENTION

It is therefore an objective of the present invention to provide a shelf pivotally coupled to a pair of stanchions and a brace rotatable relative to the shelf to selectively engage at least one of the stanchions.

It is therefore yet another objective of the present invention to provide a shelving system in which one or more of the shelves coupled to a pair of stanchions may be moved from a stored position to a working position.

It is therefore still yet another objective of the present invention to achieve the above objects while providing a shelving system in which a shelving brace is rotatable relative to a shelf and storable within a recess formed in an underside of the shelf.

The present invention achieves the above objects and advantages, and other objects and advantages that will become apparent from the following description, by providing a shelving system that includes a pair of stanchions securable to a vertical surface, each stanchion having a plurality of openings. The shelving system further includes a shelf having a bolt system (e.g. bolts) operable to selectively engage the openings in the stanchions. The bolt system preferably has a common rotational axis about which the shelf pivots when coupled to the stanchions. The shelf includes a brace having a first end portion pivotally coupled to the shelf and a second end portion with a pin receivable by the openings in the stanchions. In a preferred embodiment, the pins and the bolts are spring biased to an extended position. In this manner, the shelves are movable between a substantially flush, stored position and a deployed, working position. Once installed, the user can recover space occupied by the deployed shelving system for other purposes, such as storing a second car in the garage.

In an alternate embodiment of the invention, a shelving system includes a pair of stanchions each having a front portion, a back portion, and a plurality of openings, the back portions in contact with a vertical surface; a shelf pivotally coupled to the stanchions, the shelf having a shelving surface and an opposing surface, the shelf moveable to a stored position in which the shelving surface is substantially parallel to the vertical surface, the shelf moveable to a working position in which the shelving surface is substantially perpendicular to the vertical surface; and a brace having a first portion and a second portion, the first portion pivotally coupled to the opposing surface, the second portion having a pin receivable by the openings in the stanchions when the shelf is in the stored position.

DETAILED DESCRIPTION OF THE PREFERRED EMBODIMENTS

Figure 1:
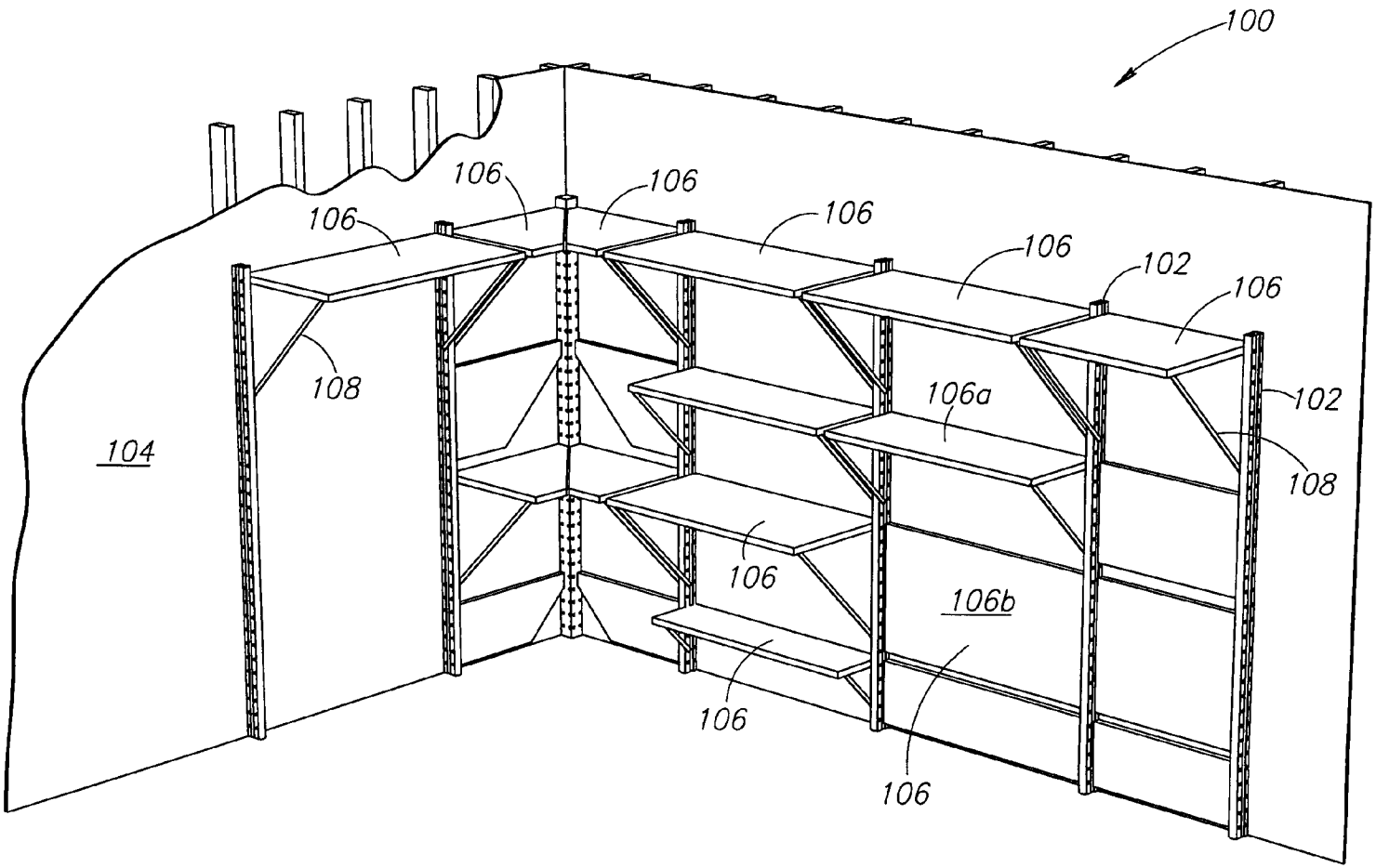
FIG. 1 is a front perspective view of a shelving system in accordance with an embodiment of the invention.

A shelving system in accordance with the principles of the invention is generally indicated at reference numeral 10 in the various figures of the attached drawings wherein numbered elements in the figures correspond to like numbered elements herein. For purposes of this description, numbered elements are carried over to correspond to like numbered elements in the various figures.

FIG. 1 shows a shelving system generally indicated a reference numeral 100 according to an embodiment of the present invention having pairs of stanchions 102 attached to a substantially vertical surface 104 such as a garage wall. Each pair of stanchion supports at least one and preferably a plurality of pivotable shelves 106. Each shelf 106 is coupled to and supported by two corresponding braces 108, which are selectively attachable to the stanchions 102. In addition, the vertical surface 104 may be interpreted as any structural, architectural, or support member capable of bearing at least a portion of a total weight of the shelving system 100. For example, the vertical surface 104 may include, but is not limited, an interior wall, an exterior wall, a garage wall, a cement wall, or a framing member (e.g., a stud with or without drywall placed thereon). The shelving system 100 may be installed, assembled and used in variety of environments such as, but not limited to a garage, a storage room, a warehouse, etc. In addition, the shelving system 100 may be installed around doors, windows, washers, dryers, etc. while also utilizing the space above and below these areas.

A purpose of the shelving system 100 is to selectively maximize an amount of storage or working space in a given area. For example, the shelving system 100 allows a user to deploy at least one or more of the shelves 106 into a working position for a project, as indicated by shelf 106*a*, and then move one or more shelves 106 into a stored position, as indicated by shelf 106*b*, once the project is complete. For example, some of the shelves 106 may be moved into their stored position so the user can park a vehicle in a garage and allow enough space to comfortably exit the vehicle. In another embodiment, the shelving system 100 may be used to display products during business hours and then after business hours, when the products have been put away, the shelves can be easily moved to their stored position and the room used for a different purpose (e.g., sales seminar).

In one embodiment, the shelving system 100 is a modular shelving system with components that may be customized based on an end-user's needs. A standard shelving system 100 may be based on sixteen inch centers typically found in most building construction. However, other spacing configurations are possible. The stanchions 102 are attached to the frame members (e.g., studs) of the building such as by screws, lag bolts or the like (not shown) and one or more shelves 106 may be placed in any aligned openings 110 formed in each stanchion 102 such that different shelves may be at different elevations relative to a ground level.

Figure 2:
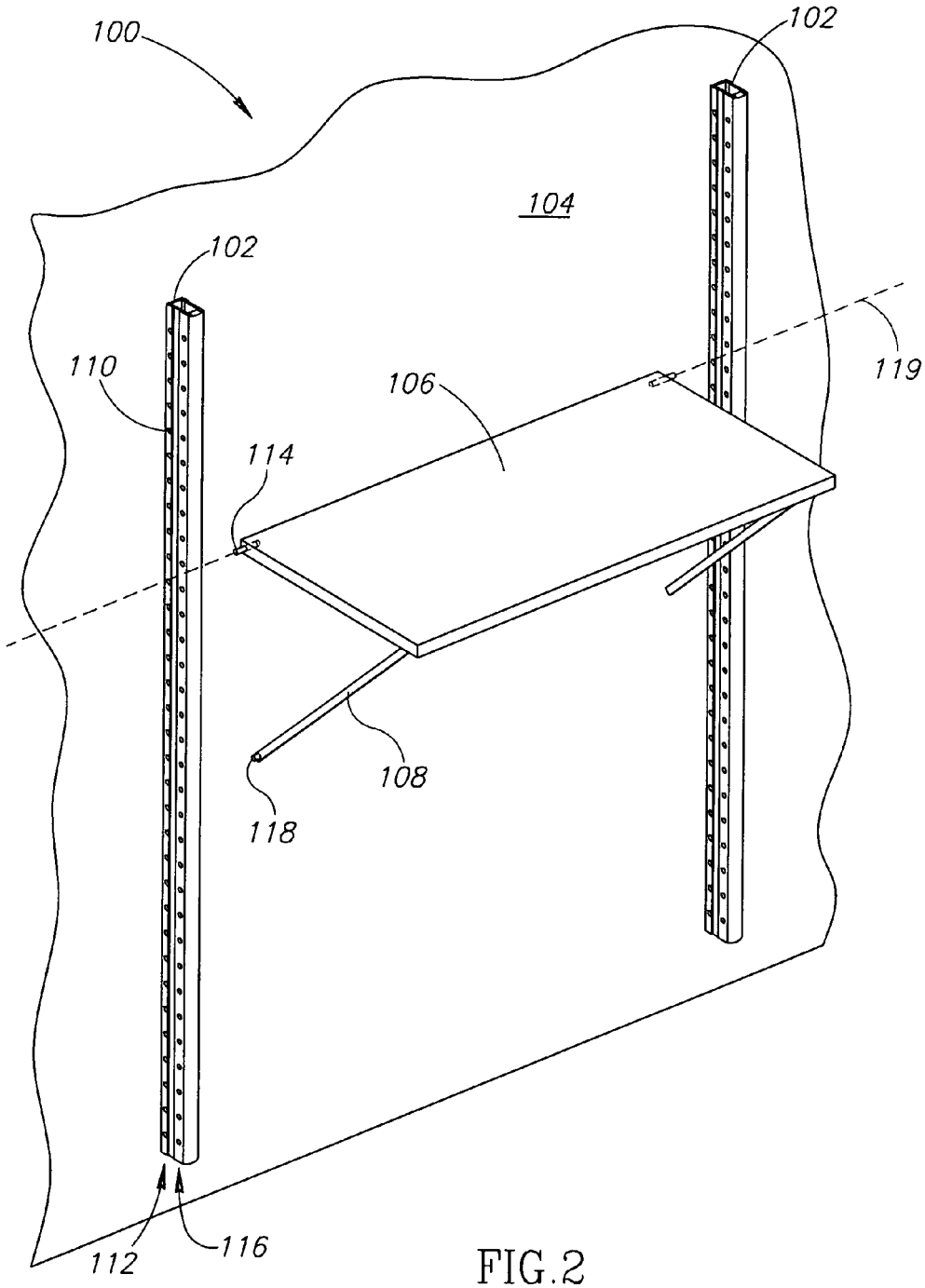
FIG. 2 is an exploded, top left side perspective view of a shelf from the shelving unit of FIG. 1.

FIG. 2 shows one shelf 106 of the shelving system 100 with a pair of stanchions 102. In the illustrated embodiment, the openings 110 are regularly spaced in lateral opposion to one another and are vertically positioned in two columns, a first column 112 for receiving bolts 114 coupled to the shelf 106 and a second column 116 for receiving pins 118 coupled to the braces 108. The openings 110 may be circular, elliptical or take some other shape provided that they closely receive the bolts 114 and pins 118. By way of example, the bolts 114 may, but are not limited to, take the form of spring loaded barrel bolts, spring loaded slide bolts, spring loaded barrel slide bolts, or push bolts manufactured by Sugatsune America, Inc or one if its related companies. The braces 108 are pivotally coupled to the shelf 106 and may be stored in recesses formed in the shelf as will be described below. The pins 118 coupled to the braces 108 may be biased or static. The shelf 106 may be moved to its working position 106*a* (FIG. 1) by rotating it approximately ninety degrees about a common rotational axis 119 about which the shelf 106 pivots when coupled to the stanchions 102.

Figure 3A:
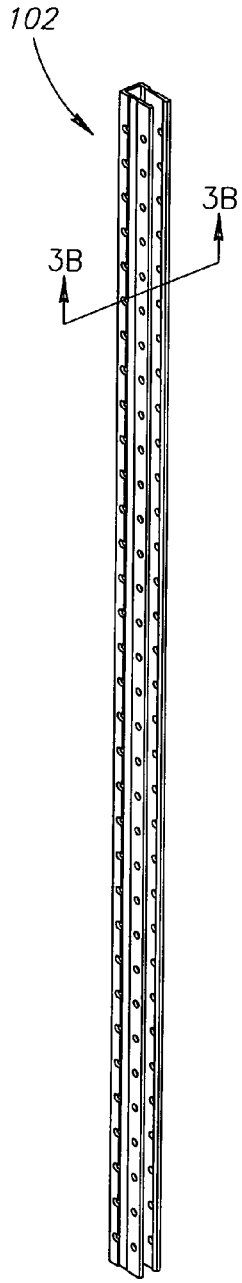
FIG. 3A is a top left perspective view of one of the stanchions of FIG. 1.
Figure 3B:
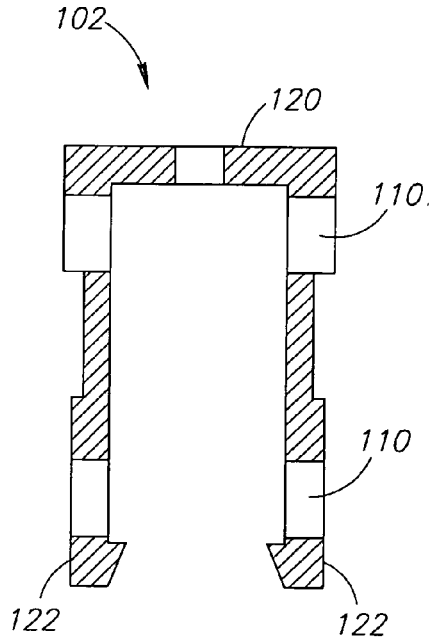
FIG. 3B is a cross-sectional view of one of the stanchions of FIG. 1 taken along line 3B-3B of FIG. 3A.
Figure 3C:
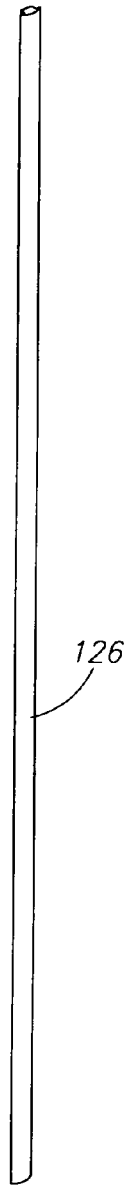
FIG. 3C is a top left perspective view of cover for a stanchion in accordance with an embodiment of the invention.

FIGS. 3A and 3B show the stanchion 102 having a U-shaped cross-sectional shape in which the back 120 of the "U" contacts the vertical surface 104 (FIG. 1) and the sides 122 of the "U" include the openings 110 for receiving the bolts 114 and pins 118, respectively. In one embodiment, the openings 110 are formed at a uniform, desired distance apart over a vertical height of the stanchions 102. The back 120 of the stanchion 102 also includes openings 124 to receive fasteners (not shown) for attaching the stanchion 102 to the vertical surface 104 (FIG. 1). FIG. 3C shows an optional cover 126 that may be coupled to or otherwise attached to the stanchion 102 to give it a more pleasing aesthetic look and to provide an element of protection for anything that may come into contact with the stanchion 102 (e.g., car door). The cover 126 may take the form of a molded or soft plastic cap for covering a forward portion of the stanchion 102. The stanchion 102 is itself preferably extruded from aluminum or another suitable material and then stamped or drilled to form the openings 110 as may be appropriate.

Figure 4A:
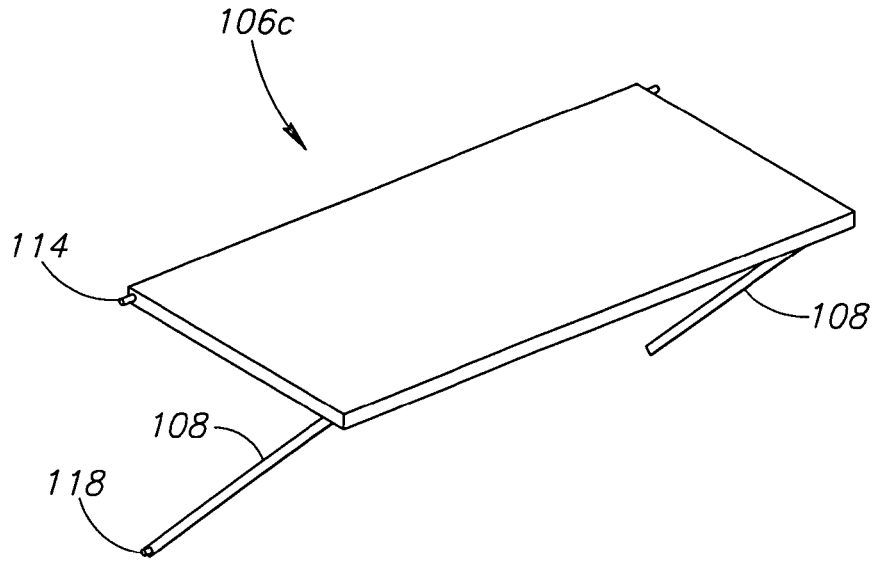
FIG. 4A is a perspective view of a rectangular shaped shelf of FIG. 1.
Figure 4B:
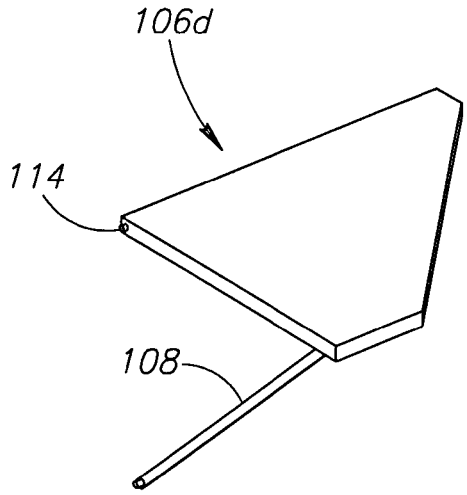
FIG. 4B is a perspective view of a corner shelf of FIG. 1.

FIGS. 4A and 4B show two types of shelves 106. More specifically, FIG. 4A shows a rectangular shelf 106*c* and FIG. 4B shows a corner shelf 106*d*. The corner shelf 106*d* includes one bolt 114, and one brace 108 with a pin 118.

Figure 5:
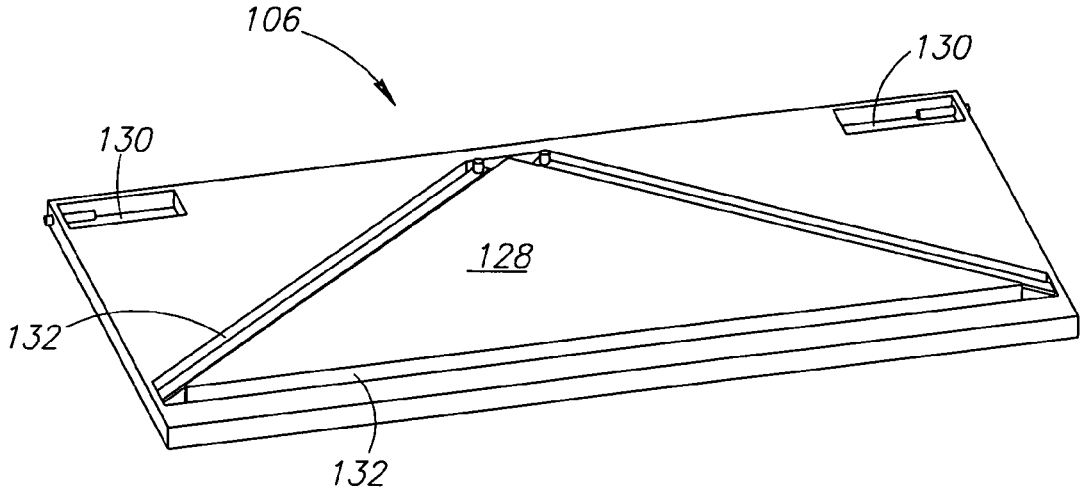
FIG. 5 is a perspective, view of a shelf according to an illustrated embodiment of the invention.

FIG. 5 shows the shelf 106 and more particularly a molded, underneath side 128 of the shelf 106 according to an embodiment of the present invention. The underneath side 128 includes recesses 130 for receiving the bolts 114, V-shaped recesses or channels 132 for receiving the braces 108 when the shelf 106 is placed into the stored position 106*b* (FIG. 1). In one embodiment, the shelf 106 is made from an injection molded plastic material. The shelf 106 may be reinforced with rods, bars or other structural components. The braces 130 may be pivotally attached to the shelves 106 by conventional hinges (not shown) at an angle of approximately forty-five degrees.

Figure 6:
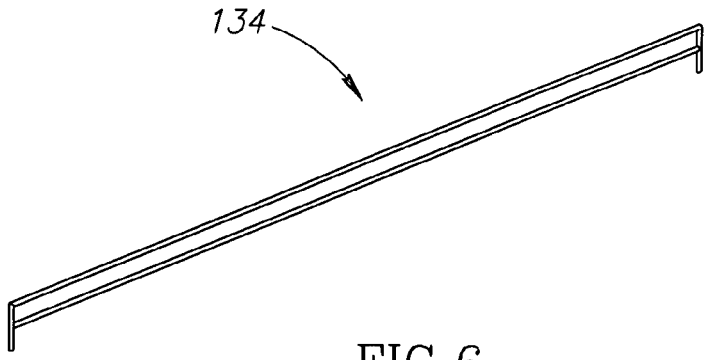
FIG. 6 is a perspective view of a rail for a shelf underside according to an illustrated embodiment of the invention.

FIG. 6 shows an optional rail 134 that may be coupled to a shelf 106. The rail operates to keep objects from rolling or otherwise coming off the outer edge of the shelf 106.

In operation, the shelves 106 of the shelving system 100 may be attached to the stanchions 102 by pressing the bolts 114 into the openings 110. Next the shelves 106 may be moved to their working position by rotating them approximately ninety degrees about a common rotational axis 119 about which the shelf pivots when coupled to the stanchions. By way of example, spring loaded barrel bolts 114 may be released from their catches and inserted into the openings 110. The braces 108, pivotally coupled to the shelves 106, are rotated out and the pins 118 are pressed into the openings 110. The pins 118 may be sized to have a friction fit requiring them to pressed in with a sufficient amount of pressure so they cannot be knocked out accidently.

While the preferred embodiment of the invention has been illustrated and described, as noted above, many changes can be made without departing from the spirit and scope of the invention. For example, in some embodiments the stanchions may have other cross-sectional profiles to allow the system to be installed on curved surfaces. Accordingly, the scope of the invention is not limited by the disclosure of the preferred embodiment. Instead, the invention should be determined entirely by reference to the claims that follow.

I claim:

1. A shelving system comprising:

a pair of substantially U-shaped stanchions being spaced apart by a desired distance and securable to a vertical surface, each stanchion defining a plurality of laterally opposed openings;

a shelf having a bolt system with a plurality of bolts operable to selectively and cooperatively engage the openings in the stanchions, the bolts having a common rotational axis about which the shelf pivots when coupled to the stanchions; and a brace having a first end portion pivotally coupled to the shelf and a second end portion having a pin adapted for cooperative receipt by the openings in the stanchions whereby the shelf is moveable between a substantially stored position and a substantially deployed position, wherein the laterally opposed openings include a rear column of openings and a forward column of openings, wherein the bolt system engages the rear column of openings and the pin engages the forward column of openings.

2. The shelving system of claim 1, wherein the bolts are spring-biased to an extended position.

3. The shelving system of claim 1, further comprising an end cap located on an end portion of the stanchion.

4. The shelving system of claim 1, wherein the shelf includes a recess formed in a bottom side of the shelf, the recess configured to receive the brace when the shelf is in the stored position.

5. The shelving system of claim 1, wherein the shelf is manufactured from a molded, reinforced plastic material.

6. The shelving system of claim 1, wherein the bolts are spring-loaded, barrel bolts.

7. The shelving system of claim 1, wherein the brace first end portion is pivotally coupled to the shelf at approximately a forty-five degree angle with respect thereto.

8. The shelving system of claim 1, wherein the pin is spring-loaded and biased to an extended position.

9. A shelving system, comprising:

a pair of substantially U-shaped stanchions being spaced apart by a desired distance and laterally opposed each having a front portion, a back portion, and a laterally opposed of openings, the back portions in contact with a vertical surface;

a shelf pivotally coupled to the stanchions, the shelf having a shelving surface and an opposing surface, the shelf moveable to a stored position in which the shelving surface is substantially parallel to the vertical surface, the shelf moveable to a working position in which the shelving surface is substantially perpendicular to the vertical surface; and a brace having a first portion and a second portion, the first portion pivotally coupled to the opposing surface, the second portion having a pin receivable by one of the openings in the stanchions when the shelf is in the working position, wherein the shelf includes a bold system having a common rotational axis about which the shelf pivots when moving from the stored position to the working position, wherein the laterally opposed openings include a rear column of openings and a forward column of opening, wherein the bolt system engages the rear column of openings and the pin engages the forward column of openings.

10. The shelving system of claim 9 wherein the shelf includes a width that is less than the desired distance.

11. The shelving system of claim 9, wherein the bolt system includes a spring-biased bolt system.

12. The shelving system of claim 9, wherein the opposing surface of the shelf includes a recess configured to receive the brace when the shelf is in the stored position.

13. The shelving system of claim 9, wherein the shelving surface is substantially flush with the front portions of the stanchions.

* * * * *